US011261728B2

(12) United States Patent
Almulla

(10) Patent No.: US 11,261,728 B2
(45) Date of Patent: Mar. 1, 2022

(54) INTERSECTING AN EXISTING WELLBORE

(71) Applicant: Saudi Arabian Oil Company, Dhahran (SA)

(72) Inventor: Jassim M. Almulla, Alkhobar (SA)

(73) Assignee: Saudi Arabian Oil Company, Dhahran (SA)

( * ) Notice: Subject to any disclaimer, the term of this patent is extended or adjusted under 35 U.S.C. 154(b) by 28 days.

(21) Appl. No.: 16/940,106

(22) Filed: Jul. 27, 2020

(65) Prior Publication Data

US 2022/0025762 A1 Jan. 27, 2022

(51) Int. Cl.

| | |
|---|---|
| ***E21B 47/09*** | (2012.01) |
| ***E21B 44/00*** | (2006.01) |
| ***E21B 47/024*** | (2006.01) |
| ***E21B 7/04*** | (2006.01) |
| ***E21B 33/13*** | (2006.01) |

(52) U.S. Cl.

CPC ..... *E21B 47/09* (2013.01); *E21B 7/04* (2013.01); *E21B 44/00* (2013.01); *E21B 47/024* (2013.01); *E21B 33/13* (2013.01)

(58) Field of Classification Search

CPC . E21B 47/09; E21B 7/04; E21B 44/00; E21B 47/024; E21B 33/13

See application file for complete search history.

(56) References Cited

U.S. PATENT DOCUMENTS

| | | | | |
|---|---|---|---|---|
| 6,199,633 | B1 | 3/2001 | Longbottom et al. | |
| 7,878,270 | B2 | 2/2011 | Lee et al. | |
| 8,835,363 | B2 | 9/2014 | Amanullah et al. | |
| 9,243,483 | B2 | 1/2016 | Keller et al. | |
| 10,381,402 | B2 | 8/2019 | Harrabi | |
| 2004/0108110 | A1* | 6/2004 | Zupanick | E21B 43/14 166/245 |
| 2017/0321535 | A1* | 11/2017 | Hay | E21B 47/04 |

* cited by examiner

*Primary Examiner* — Dany E Akakpo

(74) *Attorney, Agent, or Firm* — Fish & Richardson P.C.

(57) ABSTRACT

A method that includes receiving, by a processing device communicatively coupled to one or more sensors residing at or near a downhole end of a drill string, location information from the one or more sensors. The location information includes a location of particles adhered to a wall of a downhole section of a first wellbore. The method also includes determining, by the processing device and based on the location information, a trajectory of a second wellbore configured to intersect the first wellbore at the downhole section of the first wellbore. The method also includes transmitting, by the processing device to a receiver communicatively coupled to the processing device, the trajectory of the second wellbore to an operator or a controller to drill the second wellbore.

20 Claims, 3 Drawing Sheets

INTERSECTING AN EXISTING WELLBORE

FIELD OF THE DISCLOSURE

This disclosure relates to wellbores, in particular, to drilling non-vertical wellbores.

BACKGROUND OF THE DISCLOSURE

During drilling operations, wellbore equipment can become stuck in the wellbore due to differential pressures in the wellbore, equipment failure, and other related reasons. To recover parted or stuck downhole equipment, a fishing operation is often performed. When the fishing operation fails to retrieve the stuck component, the wellbore is often plugged and abandoned and a sidetracking operation is performed above the plug. Methods and equipment for improving drilling operations in a plugged wellbore are sought.

SUMMARY

Implementations of the present disclosure include a method that includes receiving, by a processing device communicatively coupled to one or more sensors residing at or near a downhole end of a drill string, location information from the one or more sensors. The location information includes a location of particles adhered to a wall of a downhole section of a first wellbore. The method also includes determining, by the processing device, based on the location information, a trajectory of a second wellbore. The trajectory intersects the first wellbore at the downhole section of the first wellbore. The method also includes transmitting, by the processing device to a receiver communicatively coupled to the processing device, the trajectory of the second wellbore to an operator or a controller to drill the second wellbore.

In some implementations, the second wellbore extends from an uphole section of the first wellbore to an intersection location at the downhole section of the first wellbore. Determining the trajectory of the second wellbore includes determining the intersection location. In some implementations, the uphole section of the first wellbore includes a vertical section and the downhole section of the first wellbore includes a non-vertical section. The first wellbore includes an obstruction residing between the non-vertical section and the vertical section. The second wellbore includes a non-vertical wellbore extending from the vertical section to the non-vertical section and around the obstruction. Determining the intersection location includes determining a location of a point at the downhole section between the obstruction and a downhole end of the first wellbore. In some implementations, the method also includes determining, by the processing device, based on the trajectory of the second wellbore, an orientation of the drill string to drill the second wellbore along the trajectory of the second wellbore.

In some implementations, the trajectory includes 1) a kick-off point of the second wellbore and 2) the intersection location. The kick-off point is at the uphole section of the first wellbore and the intersection location is at the downhole section of the first wellbore. Determining the orientation of the drill string includes determining a tool face angle of a drill bit of the drill string to drill the second wellbore from the kick-off point to the intersection location. In some implementations, the particles include microscopic particles adhered to the wall of the first wellbore during drilling of the first wellbore using drilling fluid mixed with the microscopic particles. The one or more sensors detect a location of the microscopic particles, and determining the trajectory of the second wellbore includes 1) determining a location of the obstruction, 2) determining, based on the location information and the location of the obstruction, a location of a portion of particles disposed downhole of the obstruction, and 3) determining, based on the location of the portion of the particles, a kick-off point of the second wellbore and the intersection location.

In some implementations, the receiver is part of a controller operationally coupled to the drill string. The controller orients the drill string to drill the second wellbore along the trajectory of the second wellbore. In some implementations, the processing device, the sensors, and the receiver are part of a bottom hole assembly of the drill string, and determining the trajectory of the second wellbore includes determining the trajectory while the bottom hole assembly is disposed inside the first wellbore.

Implementations of the present disclosure include a method that includes deploying a drill string within a first wellbore. The drill string includes one or more sensors that reside at or near a downhole end of the drill string. The one or more sensors detect location information including a location of particles adhered to a wall of a downhole section of the first wellbore. The downhole section extends from an obstruction at the wellbore to a downhole end of the wellbore. The method also includes determining, based on the location information detected by the one or more sensors, a trajectory of a second wellbore. The trajectory extends from an uphole section of the first wellbore uphole of the obstruction to the downhole section of the first wellbore. The method also includes drilling the second wellbore along the trajectory of the second wellbore.

In some implementations, determining the trajectory includes determining at least one of a kick-off point of the second wellbore, an angle of inclination of the second wellbore, or an intersection location of the second wellbore.

In some implementations, the uphole section includes a vertical section of the first wellbore and the downhole section includes a non-vertical section of the first wellbore. Drilling the second wellbore includes orienting, at the vertical section, a drill bit of the drill string in a direction along the determined trajectory of the second wellbore.

In some implementations, the method also includes further including, before deploying the drill string, drilling, with a second drill string, the first wellbore. Drilling the first wellbore includes flowing a drilling fluid including the particles that are configured to adhere to a wall the first wellbore during drilling of the first wellbore. The wall of the first wellbore includes the wall of the section of the first wellbore.

In some implementations, the method also includes, after drilling the first wellbore and before deploying the drill string: 1) determining that the first wellbore has an obstruction, 2) retrieving the second drill string from the first wellbore, and 3) plugging the obstruction. In some implementations, the particles include silicone nanoparticles and the one or more sensors detect a location of the silicone nanoparticles.

Implementations of the present disclosure include a drilling assembly that includes a drill string disposed within a first wellbore, a processor coupled to the drill string, and one or more particle sensors communicatively coupled to the processor. The one or more sensors are attached to a downhole end of the drill string. The one or more particle sensors detect and transmit, to the processor, location information including a location of particles adhered to a wall of a downhole section of the first wellbore. The processor determines, based on the location information, a trajectory of a second wellbore intersecting the downhole section of the first wellbore to drill the second wellbore along the trajectory of the second wellbore.

In some implementations, the trajectory extends from an uphole section of the first wellbore to an intersection location at the downhole section of the first wellbore, and the drill string is configured to drill the second wellbore along the determined trajectory. In some implementations, the uphole section of the first wellbore includes a vertical section and the downhole section of the first wellbore includes a non-vertical section. The first wellbore includes an obstruction that resides between the non-vertical section and the vertical section. The second wellbore includes a non-vertical wellbore extending from the vertical section to the non-vertical section and around the obstruction. The processor determines the intersection location by determining a location of a point at the downhole section between the obstruction and a downhole end of the first wellbore.

In some implementations, the drilling assembly includes a controller coupled to a downhole end of the drill string. The processor determines, based on the trajectory of the second wellbore, an orientation of the drill string to drill the second wellbore along the trajectory of the second wellbore. The controller changes a position of the drill string based on the determined orientation.

In some implementations, the processor and the one or more sensors are attached to a bottom hole assembly of the drill string. The sensors detect the location information with the bottom hole assembly disposed at the uphole section.

In some implementations, the particles include microscopic particles adhered to the wall of the first wellbore during drilling of the first wellbore using drilling fluid mixed with the microscopic particles. The one or more sensors detect a location of the microscopic particles. The processor generates, based on the location of the microscopic particles, a three dimensional model of the downhole section of the first wellbore to determine an intersection location of the second wellbore.

DETAILED DESCRIPTION OF THE DISCLOSURE

The present disclosure describes a system for accurately detecting a location of a plugged non-vertical wellbore to intersect the wellbore and thus avoid drilling a new wellbore. When retrieving the drill string from a non-vertical wellbore, a fish (e.g., the bottom hole assembly or the drill bit) may become stuck in the heel section of the wellbore. In some cases, the fish cannot be removed so a portion of the non-vertical wellbore is plugged and the entire section of the wellbore downhole of the fish is abandoned. The section is abandoned because intersecting such section to preserve the existing wellbore is difficult. The system of the present disclosure utilizes Nanoparticles mixed with the drilling fluid as markers to map a location or orientation of the existing non-vertical wellbore. The Nanoparticles adhere to the wall of the non-vertical wellbore to provide a three-dimensional location of the wellbore when detected by a Nanoparticle monitoring device. Upon plugging the blocked section of the wellbore, a drill string with a Nanoparticle monitoring device near its drill bit drills around the plug toward the section of the existing non-vertical wellbore downhole of the plug. The drill string uses the location of the Nanoparticles to determine an intersection location of the existing non-vertical wellbore downhole of the obstruction.

Particular implementations of the subject matter described in this specification can be implemented so as to realize one or more of the following advantages. For example, drilling around a plug to save an existing wellbore can save time and resources by avoiding the need of drilling a sidetrack wellbore. The methods and equipment of the present disclosure allows the recovery of lost laterals due to stuck equipment, which has been unsuccessful previously due to the difficulty of accurately intersect the original hole. Additionally the method and equipment of the present disclosure allows surveying a drilled section in real time, drilling relief wells in well control situations, and helping in drilling complex wellbore trajectories.

Figure 1:
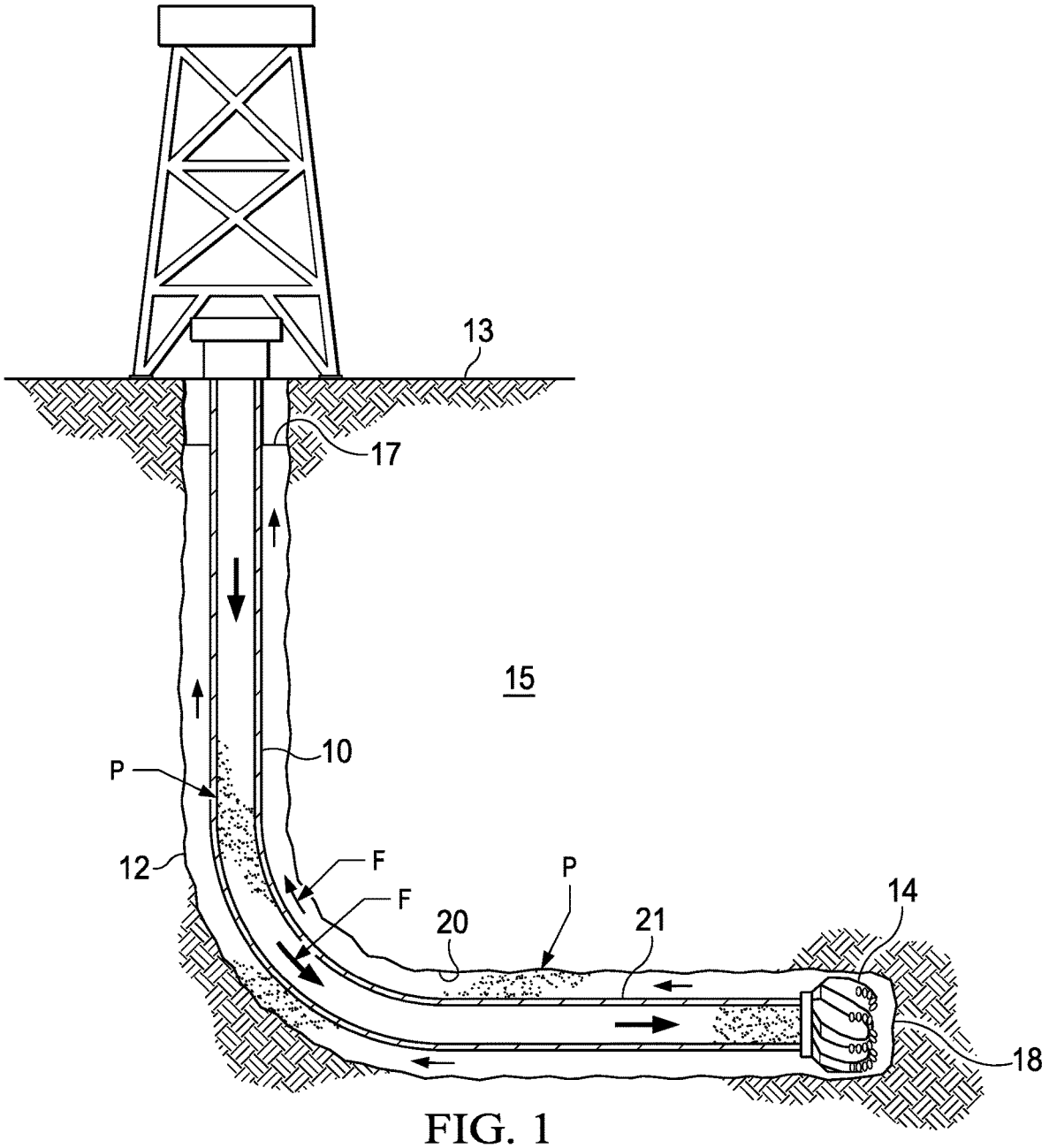
FIG. 1 is a front schematic view, partially cross sectional, of a wellbore assembly according to implementations of the present disclosure.

FIG. 1 illustrates a drill string 10 disposed within a non-vertical wellbore 12. The drill string 10 has a drill bit 14 attached to a downhole end of the drill string 10. The wellbore 12 is formed in a geologic formation 15. The geologic formation 15 may include a hydrocarbon reservoir from which hydrocarbons can be extracted.

The drill string 10 flows a drilling fluid 'F' from a surface 13 of the wellbore 12 to a downhole end 18 of the wellbore 12. The drilling fluid 'F' exits the drill bit 14 and flows in an uphole direction from the downhole end 18 of the wellbore 12 to or near the surface 13 of the wellbore 12. The drilling fluid 'F' contains particles 'P' (e.g., microscopic particles) mixed with the drilling fluid 'F'. The particles 'P' can be nanoparticles (e.g., silicone nanoparticles) that adhere or stick to a wall 20 of the wellbore 12 during drilling. For example, the particles 'P' can be mixed with the drilling fluid 'F' at the surface 13 of the wellbore and flown, with the drilling fluid, to the drill bit 14 and out the drill bit 14 to flow along an annulus 21 of the wellbore 12. Although FIG. 1 shows particles 'P' in some parts of the wellbore 12, the particles 'P' can be adhered to the entire wall 20 of the wellbore from the downhole end 18 of the wellbore 12 to a surface 17 of the drilling fluid 'F' (e.g., along the entire length of the wellbore 12 that is in contact with the drilling fluid 'F'). If the wellbore 12 is obstructed or blocked during drilling operations, the particles 'P' can be used to intersect a portion of the wellbore 12 that would otherwise might have needed to be abandoned.

Figure 2:
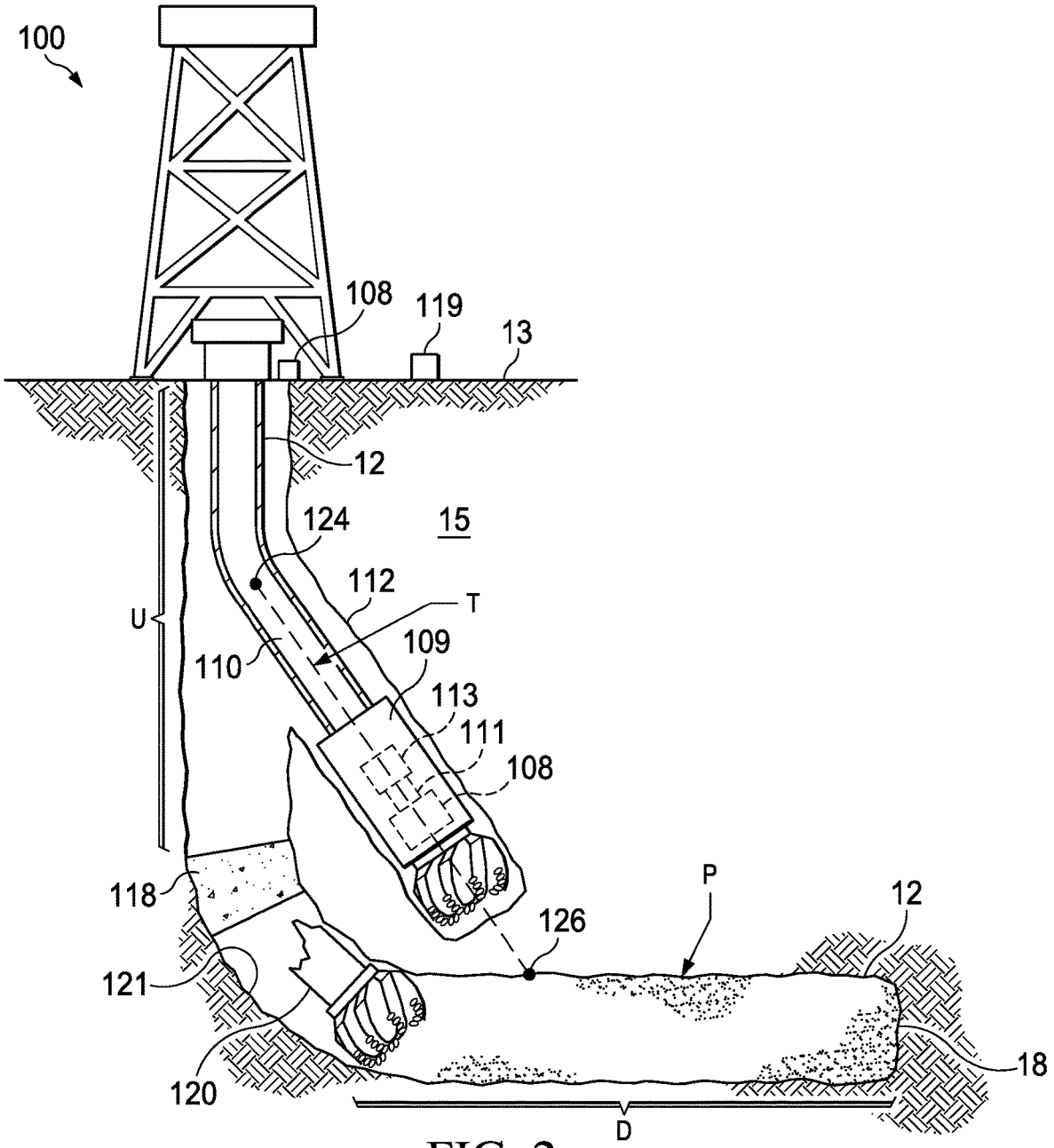
FIG. 2 is a front schematic view, cross sectional, of a portion of a wellbore assembly according to implementations of the present disclosure.

Referring to FIG. 2, a drilling assembly 100 capable of detecting the location of the particles 'P' can be used to drill around an obstruction 118 of the wellbore 12. Specifically, during drilling operations, a fish 120 (e.g., a portion of the drill string 10, a bit cone, wellbore debris, or a tool) can become stuck in the wellbore 12, creating an obstruction that prevents further drilling the wellbore 12. When fishing operations fail to remove the fish from the wellbore 12, the wellbore 12 is normally plugged (e.g., with a cement plug 118) and a section 'D' of the wellbore 12 downhole of the plug 118 and fish 120 is abandoned. The drilling assembly 100 includes a second drill string 110 and a bottom hole assembly (BHA) 109 coupled to the drill string 110. The second drilling string 110 can be deployed within the existing wellbore 12 to drill a second wellbore 112 (e.g., a branch wellbore) that intersects the downhole section 'D' of the first wellbore 12.

The drilling assembly 100 can be deployed upon plugging the first wellbore 12 or determining that the first wellbore has an obstruction. For example, upon determining that the first wellbore 12 has an obstruction, the first drill string 10 can be retrieved and the first wellbore 12 plugged with cement.

The blocked wellbore 12 has a section 'U' uphole of the plug 118 and the downhole section 'D' dowhole of the plug. The uphole section 'U' includes a vertical section of the wellbore 12 that extends from the plug 118 to the surface 13 of the wellbore 12. The downhole section 'D' includes a non-vertical section that extends from the plug 118 to the downhole end 18 of the wellbore 12.

The bottom hole assembly 109 is attached to a downhole end of the second drill string 110. The bottom hole assembly 109 can include a processing device 108 (e.g., a downhole processor) and one or more sensors 111 (e.g., particle sensors) communicatively coupled to the processor 108. The processor 108 can be attached to or be part of the bottom hole assembly 109 or can be disposed at or near the surface 13 of the wellbore 12. The sensors 111 can be part of a particle monitoring device such as a nanoparticle monitoring device.

To determine in which direction the second wellbore 112 will be drilled, the second drill string 110 is deployed within the uphole section 'U' of the wellbore 12 to allow the sensors 111 to detect the location of the particles 'P' adhered to the downhole section 'D' of the wellbore 12. The sensors 111 detect and transmit, to the processor 108, location information that includes a location of the particles 'P' or some of the particles (e.g., the particles disposed within a predetermined distance from the sensors 111) adhered to the wall 121 of the downhole section 'D' of the first wellbore 12. The processor 108 determines, based on the location information, a trajectory 'T' of the second wellbore. The trajectory 'T' can be pre-determined by computer simulations and modified with the location information from the sensors or modified due to undesirable changes in trajectory. For example, the trajectory 'T' can be determined based on the current orientation of the first wellbore and then changed as the sensors detect the location of the particles. Additionally, the processor 108 can change the trajectory 'T' due to lithology or formation change that may force the BHA 109 away from the planned trajectory. The trajectory 'T' can be directed to a high porosity formation as the data is updated while drilling. The trajectory 'T' can be a straight or curved line that extends from the uphole section 'U' of the wellbore to the downhole section 'D' of the wellbore 12, around the plug 118. In other words, the trajectory 'T' intersects the downhole section 'D' of the first wellbore 12 at an intersection point 126 that is between the plug 118 and the downhole end 18 of the first wellbore 12. The processor 108 determines the intersection location by determining a location of the point 126 disposed between the obstruction and a downhole end 18 of the first wellbore 12.

The second wellbore is drilled along the trajectory 'T'. The trajectory 'T' can be determined before drilling the second wellbore 112 or during drilling of the second wellbore 112. For example, portions of the trajectory 'T' can be determined (e.g., in real time) as the second wellbore 112 is being drilled. In example implementations, "real time" means that a duration between receiving an input and processing the input to provide an output can be minimal, for example, in the order of seconds, milliseconds, microseconds, or nanoseconds, sufficiently fast drill the second wellbore 111 without stopping the drill bit as the processor 108 is determining the trajectory T'.

The drilling assembly 100 can also include a controller 113 coupled to or near a downhole end of the second drill string 110. For example, the controller can be attached to the bottom hole assembly 109. The controller 113 can be used to control the second drill string 110 to drill the second wellbore 112 along the trajectory 'T'. For example, the processor 108 can determine, based on the trajectory 'T' of the second wellbore, an orientation of the drill string 110 to drill the second wellbore 112 along the trajectory 'T', and the controlled 113 can change the position or orientation of the drill string 110 based on the determined orientation. The controller 113 can change, for example, the tool face angle of the drill bit 114 of the second drill string 110.

The trajectory 'T' can includes a kick-off point 124 of the second wellbore 112 and the intersection location or point 126. The trajectory 'T' can be made of multiple points (e.g., each point including three-dimensional coordinates) with a common point of reference and an angle of inclination of the second wellbore. The kick-off point is at the uphole section 'U' of the first wellbore 12 and the intersection point 126 is at the downhole section 'D' of the first wellbore 12. Determining the orientation of the second drill string 110 includes determining at least one of a tool face angle, a steering direction, an azimuth angle, or inclination angle of the drill bit 114. These parameters are determined to guide the drill string 110 from the kick-off point 124 or branch out point to the intersection location 126.

The processor 108 can determine the trajectory 'T' by determining the exact or accurate three-dimensional location of the downhole section 'D' of the first wellbore 12. To do so, the processor 108 can determine the location of the obstruction or fish 120 and then determine, based on the location of the obstruction and on the particle location information received from the sensors 111, a location of a portion or group of particles that are disposed downhole of the obstruction (e.g., at the downhole section 'D'). Upon determining the location of the particles downhole of the obstruction, the processor 108 can determine the intersection location 126 (e.g., the distance of the intersection location 126 from the fish 120) and an appropriate angle of inclination of the second wellbore 112. The processor can also determine, based on an appropriate angle of inclination of the second wellbore 112, the kick-off point 124 of the second wellbore 112.

The processor 108 can send information to a receiver 119 communicatively coupled to the processor 108. The receiver can be part of a computing device with a graphical interface. In some implementations, the processor 108 can generate or help generate, with the computing device, a three dimensional model of the downhole section 'D' of the first wellbore 12 to determine an intersection location of the second wellbore. An operator can use such information to drill the second wellbore 112 (e.g., in absence of a controller 113) extending of branching out from the first wellbore 12. The processor 108 can also send trajectory or coordinate information to the display device 119 that generates, based on the trajectory information, a three dimensional model of the second wellbore 112.

In some implementations, the second wellbore 112 can be an independent wellbore that does not extend from the first wellbore 12. For example, the second wellbore can be drilled from a location at the surface 13 spaced from the first wellbore 12 to intersect the first wellbore 12.

Figure 3:
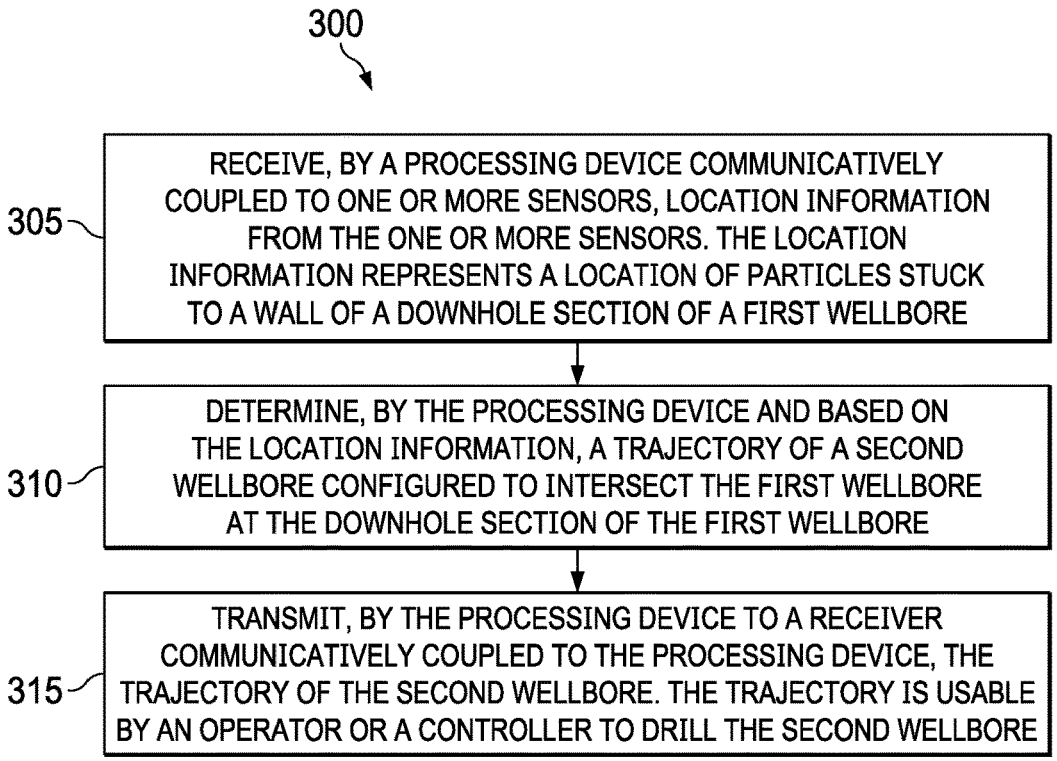
FIG. 3 is a flow chart of an example method of intersecting an existing non-vertical wellbore.

FIG. 3 shows a flow chart of an example method 300 of intersecting an existing wellbore, The method includes receiving, by a processing device communicatively coupled to one or more sensors residing at or near a downhole end of a drill string, location information from the one or more sensors. The location information includes or represents a location of particles adhered to a wall of a downhole section of a first wellbore (305). The method also includes determining, by the processing device and based on the location information, a trajectory of a second wellbore configured to intersect the first wellbore at the downhole section of the first wellbore (310). The method also includes transmitting, by the processing device to a receiver communicatively coupled to the processing device, the trajectory of the second wellbore. The trajectory can be used by an operator or a controller to drill the second wellbore (315).

Figure 4:
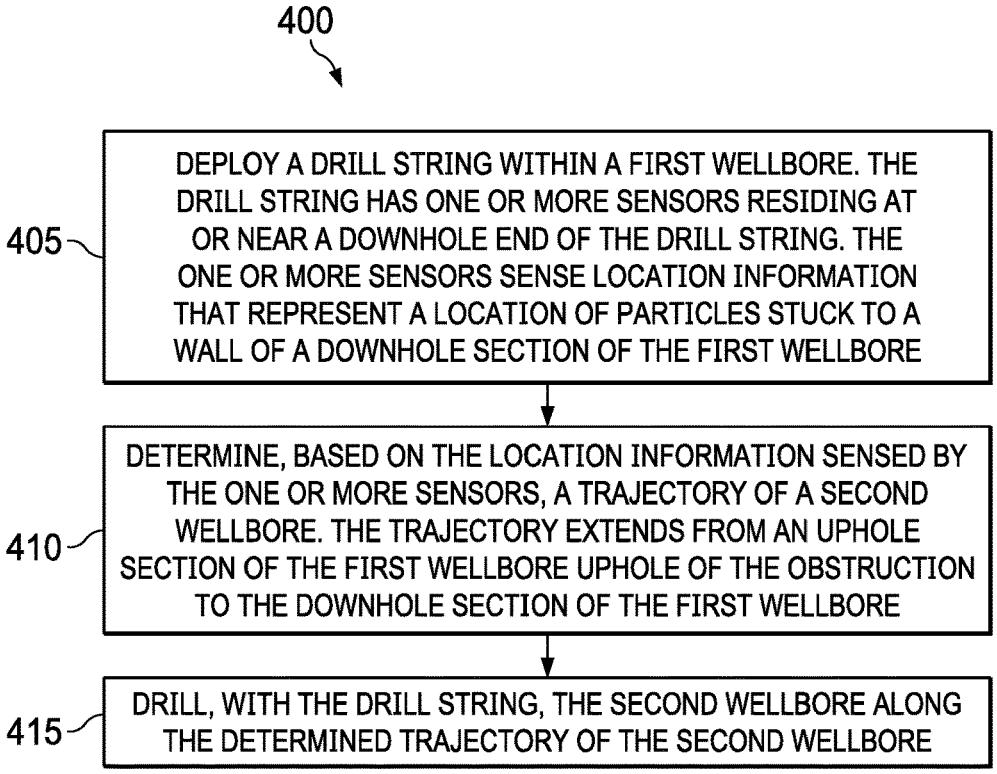
FIG. 4 is a flow chart of an example method of drilling a second wellbore.

FIG. 4 shows a flow chart of an example method 400 of drilling a second wellbore based on the location of particles. The method includes deploying a drill string within a first wellbore. The drill string has one or more sensors residing at or near a downhole end of the drill string. The one or more sensors detect location information that includes a location of particles adhered to a wall of a downhole section of the first wellbore. The downhole section extends from an obstruction at the wellbore to a downhole end of the wellbore (405). The method also includes determining, based on the location information sensed or detected by the one or more sensors, a trajectory of a second wellbore. The trajectory extends from an uphole section of the first wellbore uphole of the obstruction to the downhole section of the first wellbore (410). The method also includes drilling, with the drill string, the second wellbore along the determined trajectory of the second wellbore (415).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A method comprising:

receiving, by a processing device communicatively coupled to one or more sensors residing at or near a downhole end of a drill string, location information from the one or more sensors, the location information including a location of particles adhered to a wall of a downhole section of a first wellbore;

determining, by the processing device and based on the location information, a trajectory of a second wellbore configured to intersect the first wellbore at the downhole section of the first wellbore; and transmitting, by the processing device to a receiver communicatively coupled to the processing device, the trajectory of the second wellbore to an operator or a controller to drill the second wellbore.

2. The method of claim 1, wherein the second wellbore is configured to extend from an uphole section of the first wellbore to an intersection location at the downhole section of the first wellbore, and wherein determining the trajectory of the second wellbore comprises determining the intersection location.

3. The method of claim 2, wherein the uphole section of the first wellbore comprises a vertical section and the downhole section of the first wellbore comprises a non-vertical section, the first wellbore comprising an obstruction residing between the non-vertical section and the vertical section, the second wellbore comprising a non-vertical wellbore extending from the vertical section to the non-vertical section and around the obstruction, and wherein determining the intersection location comprises determining a location of a point at the downhole section between the obstruction and a downhole end of the first wellbore.

4. The method of claim 3, further comprising determining, by the processing device and based on the trajectory of the second wellbore, an orientation of the drill string to drill the second wellbore along the trajectory of the second wellbore.

5. The method of claim 4, wherein the trajectory comprises a kick-off point of the second wellbore and the intersection location, the kick-off point at the uphole section of the first wellbore and the intersection location at the downhole section of the first wellbore, and wherein determining the orientation of the drill string comprises determining a tool face angle of a drill bit of the drill string to drill the second wellbore from the kick-off point to the intersection location.

6. The method of claim 4, wherein the particles comprise microscopic particles adhered to the wall of the first wellbore during drilling of the first wellbore using drilling fluid mixed with the microscopic particles, the one or more sensors configured to detect a location of the microscopic particles, and determining the trajectory of the second wellbore comprises:

determining a location of the obstruction, determining, based on the location information and the location of the obstruction, a location of a portion of particles disposed downhole of the obstruction, and determining, based on the location of the portion of the particles, a kick-off point of the second wellbore and the intersection location.

7. The method of claim 1, wherein the receiver is part of a controller operationally coupled to the drill string, the controller configured to orient the drill string to drill the second wellbore along the trajectory of the second wellbore.

8. The method of claim 7, wherein the processing device, the sensors, and the receiver are part of a bottom hole assembly of the drill string, and wherein determining the trajectory of the second wellbore comprises determining the trajectory with the bottom hole assembly disposed inside the first wellbore.

9. A method comprising:

deploying a drill string within a first wellbore, the drill string comprising one or more sensors residing at or near a downhole end of the drill string, the one or more sensors configured to detect location information including a location of particles adhered to a wall of a downhole section of the first wellbore, the downhole section extending from an obstruction at the wellbore to a downhole end of the wellbore;

determining, based on the location information detected by the one or more sensors, a trajectory of a second wellbore, the trajectory extending from an uphole section of the first wellbore uphole of the obstruction to the downhole section of the first wellbore; and drilling the second wellbore along the trajectory of the second wellbore.

10. The method of claim 9, wherein determining the trajectory comprises determining at least one of a kick-off point of the second wellbore, an angle of inclination of the second wellbore, or an intersection location of the second wellbore.

11. The method of claim 9, wherein the uphole section comprises a vertical section of the first wellbore and the downhole section comprises a non-vertical section of the first wellbore, and drilling the second wellbore comprises orienting, at the vertical section, a drill bit of the drill string in a direction along the determined trajectory of the second wellbore.

12. The method of claim 9, further comprising, before deploying the drill string, drilling, with a second drill string, the first wellbore, wherein drilling the first wellbore comprises flowing a drilling fluid comprising the particles configured to adhere to the wall of the downhole section of the first wellbore during drilling of the first wellbore.

13. The method of claim 12, further comprising, after drilling the first wellbore and before deploying the drill string: determining that the first wellbore has the obstruction, retrieving the second drill string from the first wellbore, and plugging the obstruction.

14. The method of claim 12, wherein the particles comprise silicone nanoparticles and wherein the one or more sensors are configured to detect a location of the silicone nanoparticles.

15. A drilling assembly comprising:

a drill string configured to be disposed within a first wellbore;

a processor coupled to the drill string; and one or more particle sensors communicatively coupled to the processor and attached to a downhole end of the drill string, the one or more particle sensors configured to detect and transmit, to the processor, location information including a location of particles adhered to a wall of a downhole section of the first wellbore, wherein the processor is configured to determine, based on the location information, a trajectory of a second wellbore intersecting the downhole section of the first wellbore to drill the second wellbore along the trajectory of the second wellbore.

16. The drilling assembly of claim 15, wherein the trajectory extends from an uphole section of the first wellbore to an intersection location at the downhole section of the first wellbore, and the drill string is configured to drill the second wellbore along the determined trajectory.

17. The drilling assembly of claim 16, wherein the uphole section of the first wellbore comprises a vertical section and the downhole section of the first wellbore comprises a non-vertical section, the first wellbore comprising an obstruction residing between the non-vertical section and the vertical section, the second wellbore comprising a non-vertical wellbore extending from the vertical section to the non-vertical section and around the obstruction, and the processor is configured to determine the intersection location by determining a location of a point at the downhole section between the obstruction and a downhole end of the first wellbore.

18. The drilling assembly of claim 16, further comprising a controller coupled to a downhole end of the drill string, wherein the processor is configured to determine, based on the trajectory of the second wellbore, an orientation of the drill string to drill the second wellbore along the trajectory of the second wellbore, and the controller is configured to change a position of the drill string based on the determined orientation.

19. The drilling assembly of claim 16, wherein the processor and the one or more sensors are attached to a bottom hole assembly of the drill string, and wherein the sensors are configured to detect the location information with the bottom hole assembly disposed at the uphole section.

20. The drilling assembly of claim 15, wherein the particles comprise microscopic particles adhered to the wall of the first wellbore during drilling of the first wellbore using drilling fluid mixed with the microscopic particles, the one or more sensors configured to detect a location of the microscopic particles, the processor configured to generate, based on the location of the microscopic particles, a three dimensional model of the downhole section of the first wellbore to determine an intersection location of the second wellbore.

* * * * *